United States Patent [19]

Parisien

[11] 4,114,860

[45] Sep. 19, 1978

[54] FENCE SYSTEM

[76] Inventor: Rudolph E. Parisien, 891 Rainbow St., Ottawa, Canada

[21] Appl. No.: 743,474

[22] Filed: Nov. 19, 1976

Related U.S. Application Data

[63] Continuation of Ser. No. 523,129, Nov. 12, 1974, which is a continuation-in-part of Ser. No. 382,116, Jul. 24, 1973, abandoned.

[30] Foreign Application Priority Data

| | | | |
|---|---|---|---|
| Jun. 14, 1973 | [CA] | Canada | 174105 |
| Nov. 19, 1973 | [CA] | Canada | 186172 |
| Feb. 21, 1974 | [CA] | Canada | 193180 |

[51] Int. Cl.[2] ..... E04H 17/14

[52] U.S. Cl. ..... 256/65; 256/21; 248/200

[58] Field of Search ..... 256/65, 59, 21, 22, 256/24, 25; 248/200, 247, 248

[56] References Cited

U.S. PATENT DOCUMENTS

| | | | |
|---|---|---|---|
| 2,905,445 | 9/1959 | Blum | 256/65 |
| 3,071,350 | 1/1963 | Opie | 248/224.2 X |
| 3,136,530 | 6/1964 | Case | 256/65 X |
| 3,842,564 | 10/1974 | Brown | 256/59 X |

FOREIGN PATENT DOCUMENTS

| | | | |
|---|---|---|---|
| 1,248,270 | 8/1967 | Fed. Rep. of Germany | 256/65 |
| 1,913,316 | 9/1970 | Fed. Rep. of Germany | 256/59 |
| 273,893 | 6/1951 | Switzerland | 256/59 |

*Primary Examiner*—Andrew V. Kundrat
*Attorney, Agent, or Firm*—A. W. Breiner

[57] ABSTRACT

The fence includes posts composed of at least two channel members disposed at right angles to each other, the openings in the channel members being restricted so that an end link of chain link fencing can be inserted and turned so as to be retained in the channel member. The fence further includes chain link fencing, the upper portion of which, has transverse projections to be received and engage a channel member forming the top rail of the fence. The top rail is held in place on a line post by a bracket received in the upper end of the line post which may also be a channel member. The projections on the bracket engage the top rail so as to hold the rail securely against the side of the post adjacent its upper end.

7 Claims, 28 Drawing Figures

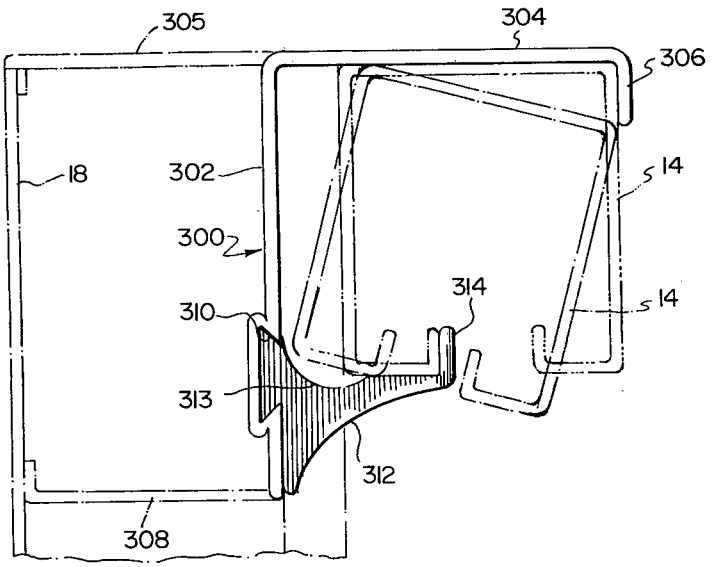
FIG. 17
FIG. 17a
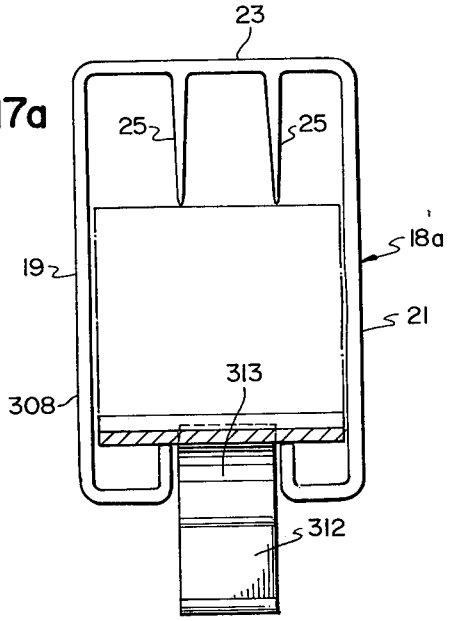

FENCE SYSTEM

This is a continuation of application Ser. No. 523,129 filed Nov. 12, 1974; which in turn is a continuation-in-part of application Ser. No. 382,116 filed July 24, 1973, now abandoned.

This invention relates to fence systems and more particularly to novel wire mesh fence or the like supported by posts which comprise channel members of rectangular cross section.

Square channel type posts are considered desireable for esthetic reasons and also to permit air circulation to avoid build up of condensation.

The various attempts to replace round posts with square posts have not been entirely satisfactory due to the high cost of tooling and production as well as the greater skill and accuracy required during installation.

It is therefor an object of this invention to provide a fence which is relatively easy to install due to fact that adjustments may be easily made to compensate for minor errors or difficult or sloping ground.

It is a further object of this invention to provide a post and related fence components which will have an improved appearance in that the majority of fittings will be concealed within the channel type fence posts.

It is also an object of the invention to reduce the number of different parts required for a fence thereby reducing the size of inventory which must be carried by those in the fence industry.

A still further object of the invention is the provision of chain link fencing and tie wires which are secured in the channel members so as to improve the appearance of the fence by eliminating the need for wires wrapped around posts or rails and to simplify installation.

Accordingly the present invention provides a fence including a post for supporting a web of fence material. The post is in the form of a pair of elongated channel members disposed at right angles to each other and secured together, each of the channel members having a pair of substantially parallel walls and an interconnecting wall, each parallel wall being bent inwardly at its outer side edge to provide a substantially J shaped cross section.

In the drawings which illustrate embodiments of this invention:

Figure 1:
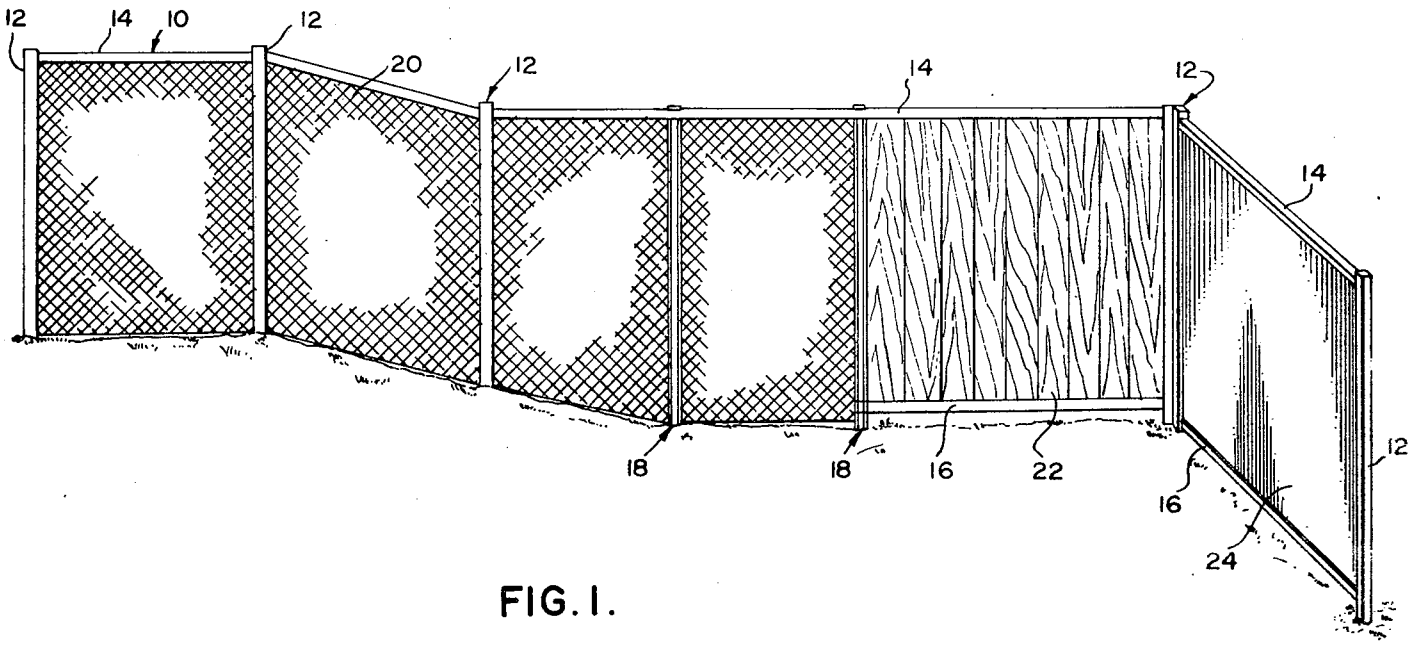
FIG. 1 is a side elevational view of the fence system of this invention.
Figure 12:
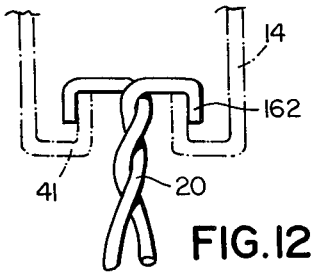
Figure 11:
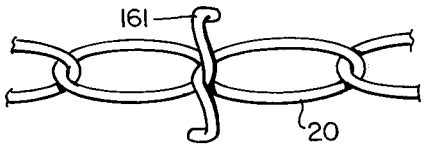
Figure 13:
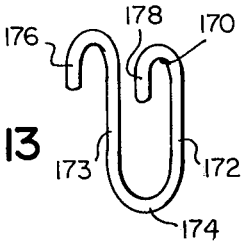
Figure 14:
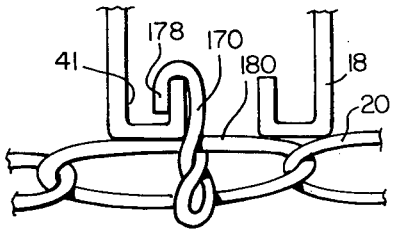

FIG. 11 is a top plan view of a section of chain link fence adapted to engage a channel type top rail, FIg. 12 is an end view of the chain link fence of FIG. 11 including the top rail shown in broken lines, FIG. 13 is a perspective view of a special tie wire, FIG. 14 is a top plan view of the tie wire of FIG. 13 securing chain link fencing to a line post FIGS. 15, 16, 17, 17*a*, 18, 19, and 20 are end views of alternate forms of the posts and line caps of FIGS. 5*a* and 6 and FIGS. 21 to 25 are perspective views of a fence panel Referring now in detail to the drawings a fence system shown generally at 10 in FIG. 1 includes terminal or corner posts 12, top rails 14, bottom rails 16 and line posts 18 which support chain link fencing 20 or other fence material such as wood slats 22 or steel panels 24.

With regard to slats 22 or panels 24 these are conveniently held by the top and bottom rails 14 and 16 since their channels face each other so as to receive the end edges of the slats or panels 22 and 24.

Figure 2:
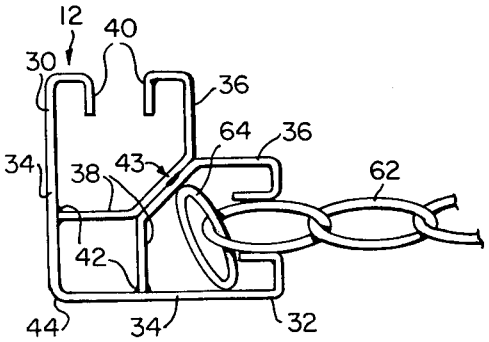
FIG. 2 is a top plan view of a terminal post of this invention showing the chain link fencing secured in one channel of the post.

The end post 12 shown more clearly in FIG. 2 comprises an elongated sheet metal member having a cross section which includes a pair of channel members 30 and 32 disposed at right angles to each other. Each channel member 30 and 32 has a pair of substantially parallel walls 34 and 36 and an interconnecting wall 38, each of the parallel walls 34 and 36 being bent inwardly at its outer side edge to provide a substantially J shaped cross section 40. It will be noted that the interconnecting walls 38 are joined to the walls 34 and to each other as by welds 42 and 43 and that walls 34 are integrally joined along a right angle bend 44.

Figure 6:
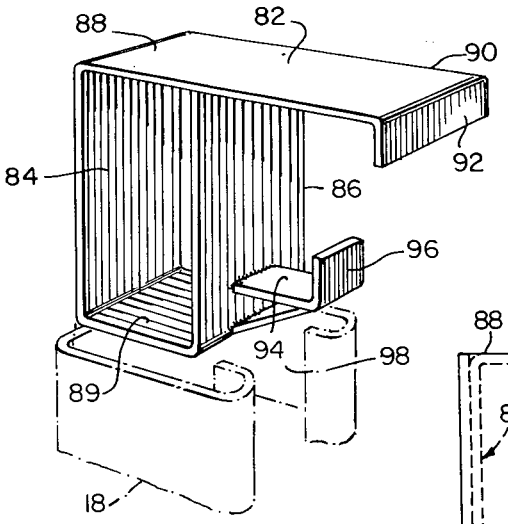
FIG. 6 is an exploded perspective view of a line post cap showing the post in broken lined.
Figure 7:
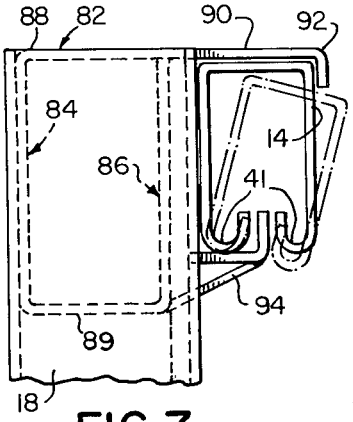
FIG. 7 is a side elevational view of the cap of FIG. 6 including a portion of a line post and an end view of a top rail.
Figure 9:
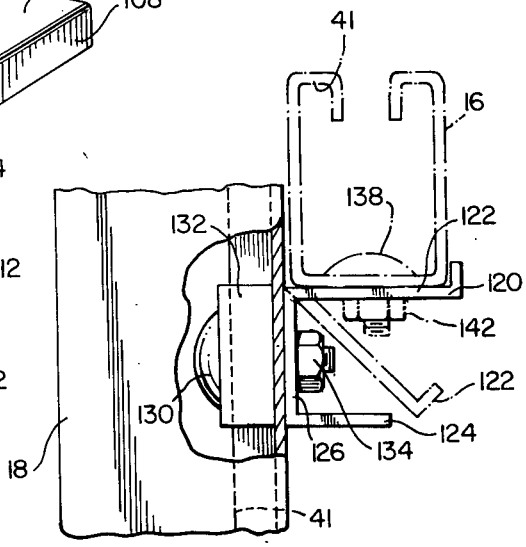
FIG. 9 is a side elevational view partly in section of a bracket for joining top rails or bottom rails to terminal posts or line posts.

It should be noted that top and bottom rails 14 and 16 and line posts 18 are channel members which also have J shaped portions indicated at 41 in FIGS. 6, 7 and 9.

Figure 4:
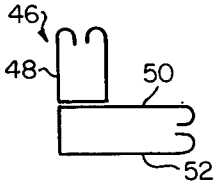
FIGS. 4, 5, 5*a* and 5*b* are diagramatic top plan views of the alternate forms of the terminal post of FIGS. 2 and 3
Figure 5:
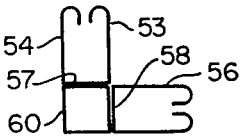

In FIG. 4 an alternate construction of the terminal post is shown at 46 wherein a channel member 48 abuts and is secured to a side wall 50 of a second channel member 52. As shown in FIG. 5 a terminal post 53 has channel members 54 and 56 which have interconnecting walls 57 and 58 secured to a square tubular member 60 to provide a configuration similar to that shown in FIG. 2.

Figure 5A:
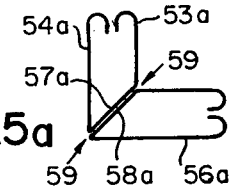

FIG. 5*a* shows yet another alternative wherein a terminal post 53*a* includes channel members 54*a* and 56*a* which have interconnecting walls 57*a* and 58*a* disposed at 45 degree angles and secured together as by welds 59. A novel means for securing chain link fencing 62 to the terminal post 12 is also shown in FIG. 2. It will be appreciated that the method of fastening is made possible by the provision of channel member 32 which receives the last link 64 of the chain link material 62. It is necessary to modify the fencing by disengaging the last link at top and bottom so it can be twisted to a postion at right angles to the main portion of the chain link 62, after insertion in the channel member 32. Any tension applied to the chain link 62 to dislodge it from the end post 12 merely causes the link 64 to bind more tightly in the channel member 32. An opposite end of the fencing 20 will be inserted in an adjacent terminal post as described above through the use of a stretcher in the usual manner.

Figure 3:
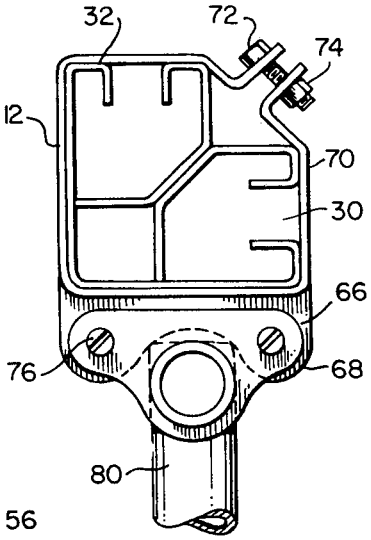
FIG. 3 is a top plan view of the terminal post of FIG. 2 and a portion of a gate including a hinge secured to the terminal post.

In FIG. 3 the terminal post 12 is shown with a hinge member 66 secured thereto by means of a flange 68 which is in turn secured to a band 70 strapped around the post 12 and secured by a bolt 72 and nut 74 in the usual manner. The hinge member 66 is conventionally secured to the flange 68 by bolts 76 passing through suitable aligned apertures in the flange 68 and the hinge member 66. The hinge member 66 co-operates with a hinge member on a gate 80.

It should be pointed out that in order to provide for escape of moisture from terminal posts such as that shown in FIG. 2 a hole may be provided slightly above ground level, in the interconnecting walls 38 or the parallel walls 36. Alternatively the parallel walls 36 and the interconnecting walls 38 may be eliminated on the lowermost two to three feet of the terminal post 12.

In FIGS. 6 and 7 a line post cap 82 is shown for use with line posts 18 and top rails 14. The line cap 82 comprises parallel side walls 84 and 86 and top and bottom walls 88 and 89 respectively. A flange 90 formed intergrally with the top wall 88 extends outwardly from the wall 86 and terminates in a right angled downwardly bent portion 92. The wall 86 has secured thereto a projection 94 having an upwardly extending portion 96. This projection 94 is so dimensioned that it will fit in the channel 98 in the line post 18. As shown in FIG. 6 the cap 82 slides down into an upper end of the line post 18. With reference to FIG. 7 a top rail 14 is received and held between the flange 90, bent portion 92 and the projection 94, with the upwardly extending portion 96 extending into the underside of the channel of rail 14. The dimensions of the cap 82 are such that the top rail 14 can be tilted inserted in the cap 82, and then straightened as shown in FIG. 7 rather than being slid in from the end. The rail 14 is thus locked firmly in place when the cap 82 is placed in the post 18.

Figure 8:
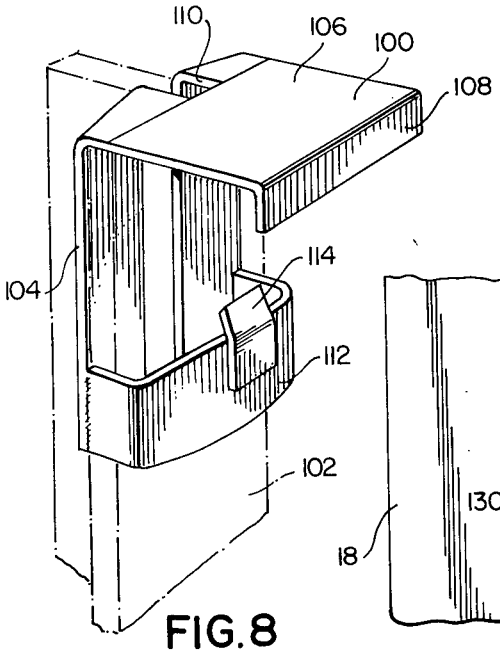
FIG. 8 is an alternative construction of the line cap for use with a line post having a T shaped cross section

In FIG. 8 an alternative construction of line post cap is shown at 100 in place on a T post 102. The cap 100 has a wall 104 which in use is vertical and a top wall 106 which has a depending flange 108. A slot 110 through which a portion of the T shaped post 102 extends, is provided in vertical wall 104. A band or strap 112 secured at its ends to the wall 104 retains the other portion of the T post when the cap 100 is slid over the upper end of the post 102. A projection 114 engages the underside of the top rail 14 while an upper portion of top rail 14 is engaged by the depending flange 108.

A bracket for supporting bottom rails 16 is shown at 120 in FIG. 9. The substantially U shaped bracket 120 has walls 122 and 124 and an interconnecting wall 126. The wall 122 is longer than the wall 124 and an upturned flange 128 which engages a side wall of bottom rail 16. The bracket 120 is secured to the line post 18 by a bolt 130 extending through apertured channel iron washer 132 and a suitable aperture in wall 126 of bracket 120 so as to be threadedly engaged by nut 134. The washer 132 engages the J shaped portions 41 of the line post 18. Similarly, a bottom rail 16 may be held in place by a bolt 138 passing through an aperture in the wall 122 of the bracket 120 to threadedly receive nut 142.

The bracket 120 is also used to support ends of top and bottom rails 14 and 16 where they abut the terminal posts 12. The ends of the rails 14 and 16 merely slide over the bracket 120 and are supported by the wall 120.

Since the bracket may be used on sloping ground it would be convenient to be able to have the rails 14 and 16 meet the bracket 120 at an angle other than ninety degrees. As shown in broken lines in FIG. 9 the wall 122 may be bent downwardly to facilitate use of the bracket 120 where bottom or top rails slope.

Figure 10:
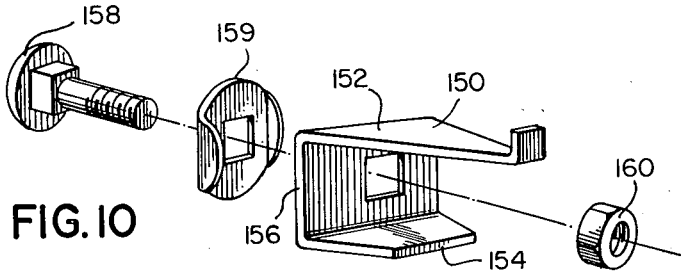
FIG. 10 is an alternative form of the bracket of FIG. 9

An alternate construction of bracket is shown at 150 in FIG. 10. The bracket 150 has walls 152, 154 and an interconnecting wall 156. A bolt 158 passing through a square aperture in a washer 159 and the apertured interconnecting wall of bracket 150 receives nut 160 so as to retain the bracket on a line post 18 or end post 12 in the same manner as described above with reference to bracket 120 in FIG. 9. The bracket 150 is of particular use in supporting top or bottom rails where corners are less than or greater than ninety degrees.

In order to attach chain link fencing 20 to top rails 14 the chain link has been modified so that the top of every few links is bent as shown in FIGS. 11 and 12. Whether the tops of the links are twisted and cut to form barbs or whether they are bent back over each other, every few links are bent as shown in FIG. 12 so that each strand 161 projects outwardly substantially at right angles and has a downwardly depending portion 162 to engage in the J shaped portions 41 of the top rail 14.

To fasten the chain link fencing 20 to the rail 16 it is necessary to turn the outwardly projecting strands 161 so as to be parallel with the channel of top rail 14, insert the strand portions 161 and then turn the strand portions 161 to a position at right angles to the rail 14.

In FIGS. 13 and 14 a special tie wire 170 is shown for use on line posts 18. The tie wire 170 comprises a U shaped wire including two legs 172 and 173 and an interconnecting portion 174. The legs 172 and 173 have hooks 176 and 178 formed in their outer ends. The hooks 176 and 178 are on the same side of the tie wire 170 and are substantially parallel.

FIG. 14 shows the tie wire in use on a line post 18. The legs 172 straddle a mesh 180 of the chain link fencing 20 and the hooks 176 and 178 are engaged in the J shaped portion 41 of the line post 18. The interconnecting portion 174 is then grasped by pliers or the like and twisted until the chain link fencing 20 is held tightly against the line post 18.

Figure 5B:
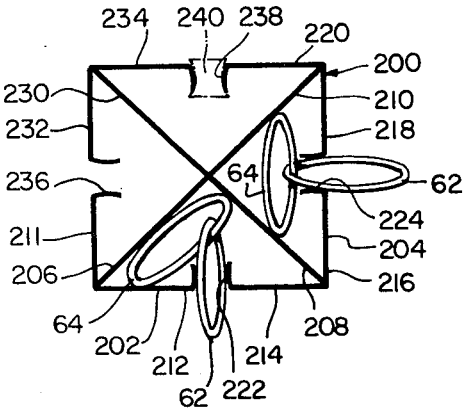

It will be understood that although the terminal posts described above with reference to FIGS. 2, 4, 5 and **5*a* are fabricated of sheet metal as by roll forming, a terminal post 200 shown in FIG. 5*b* is capable of being extruded. The terminal post 200 includes a first pair of channel members 202 and 204, opposed walls 206, 208 and 210 of which are joined at their inner side edges. Outer side edges of the opposed walls 206, 208 and 210 have inwardly bent portions 211, 212, 214, 216, 218, and 220 which define slots 222 and 224**.

Similarly, opposed wall 230 and its inwardly bent portions 232 and 234 and portions 211 and 220 define slots 236 and 238. Chain link 64 is shown inserted in channel members 202 and 204 in the same manner as described above with reference to FIG. 2 while elongated strips 240 of vinyl or other suitable material plug the slots 236 and 238. It would of course be possible to use any combination of slots to receive either plugs 240 or chain link 62.

Figure 15:
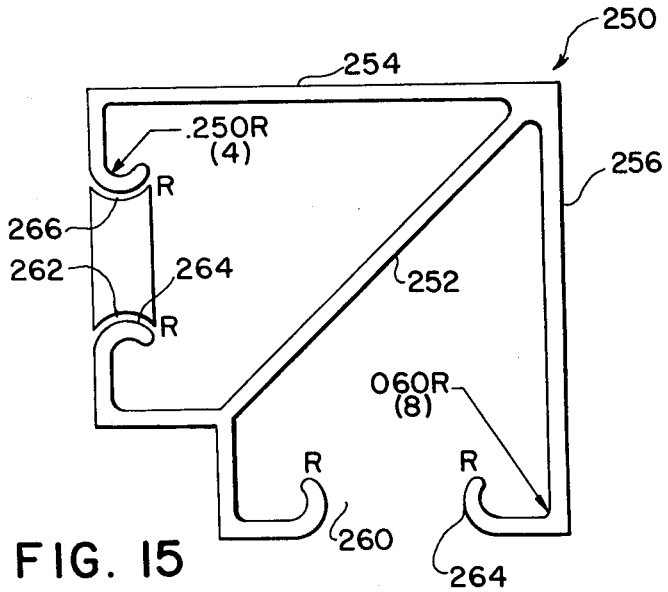

FIG. 15 shows yet another alternative wherein a terminal post 250 similar to post **53*a*, includes a pair of channels at right angles to each other. However, the post 250 is designed so as to be capable of being formed by extrusion and therefore a single interconnecting wall 252 replaces walls 57*a* and 58*a* of the post 53*a*. Channel members 254 and 256 share the common interconnecting wall 252. The J shaped portions defining slots 260 and 262 curve inwardly so as to define ridges 264 capable of receiving an insert 266** of aluminum, plastic or the like.

Figure 16:
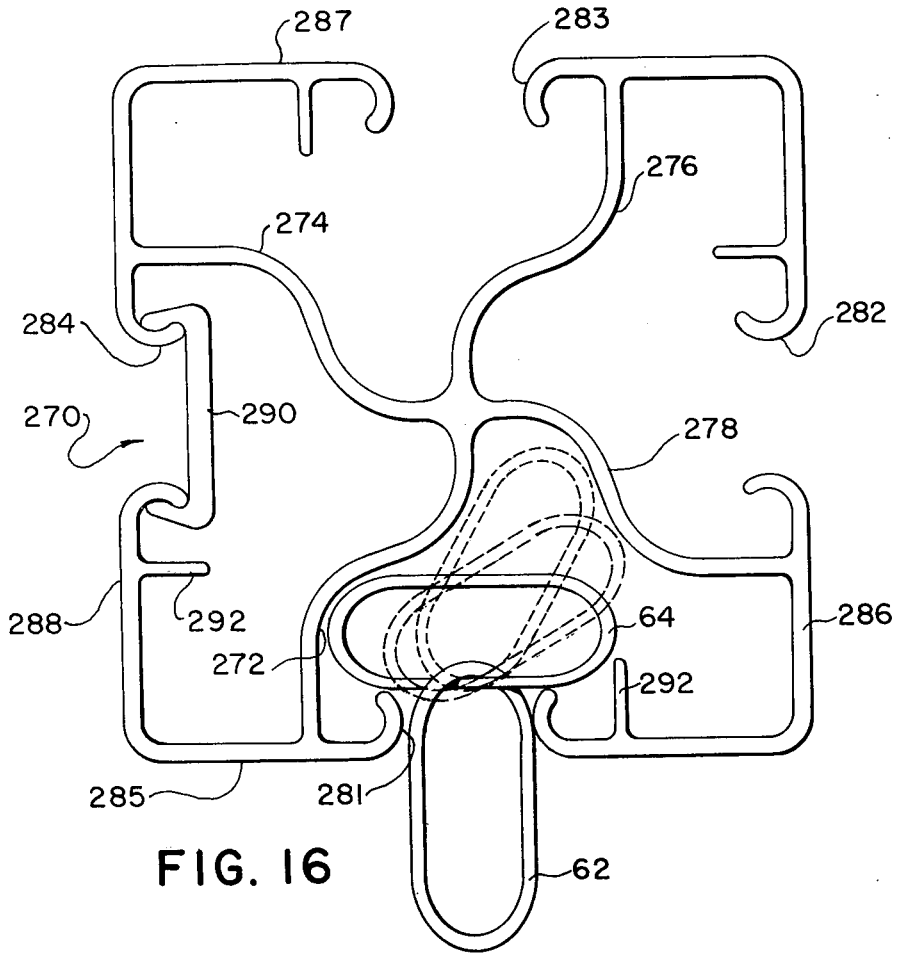

FIG. 16 a terminal post capable of being extruded is shown generally at 270. The terminal post 270 is similar to that shown at 200 in FIG. 5*b* and included four channels defined by walls 272, 274, 276 and 278 which are connected at their inner ends. The post 270 is in the form of a tube of square cross section which has slots 281, 282, 283 and 284 provided in its four walls 285, 286, 287 and 288 respectively. The edges of the slots curve inwardly so as to be capable of receiving a strip of metal or plastic as shown at 290 or a strip 266 as shown in FIG. 15.

Furthermore a rib 292 is provided adjacent each of the slots 281, 282, 283 and 284 for strengthening the post 270 and preventing the chain link 64 from moving away from the wall 272. The post 270 has S-shaped walls 285, 286, 287 and 288 in order to minimize the cross section of the post 270 while providing sufficient room for inserting the last link 64 of chain link material 62.

In FIG. 17 an alternate form of the post cap or top rail bracket of FIG. 6 is shown generally at 300. The alternate bracket 300 comprises a side wall 302 integrally joined to a top wall 304 which may include a portion 305 (shown in broken lines) adapted to cover the open upper end of the post 18. The other end of the top wall 304 terminates in an integral flange 306 extending downwardly therefrom at right angles. A bottom wall 308 integrally connected to the lower end of the side wall 302 is adapted to engage a back wall of the post 18. However, the bottom wall 308 (shown in broken lines) may be eliminated.

It will be appreciated that the bracket 300 has been designed to be fabricated of aluminum alloys by extrusion. Accordingly, the wall 302 is provided with a dove tail groove 310 to receive a dove tail projection 312 which is substantially the same as projection 94 described above with reference to FIG. 6 and has upwardly extending portion 314 adapted to extend into the underside of the rail 14 (shown in broken lines). The projection 94 is dimensioned so as to project out of the channel 98 in line post 18 in order to allow the rail 14 to be rotated into position (as shown in broken lines). The projection 312 also has a recess 313 to enable the top rail to move into position.

Figure 17*a* shows an alternate form of line post 18*a* for use in much the same manner as line post 18 shown in FIG. 7. The post 18*a* is in the form of a channel member which has a pair of parallel side walls 19 and 21 and an interconnecting wall 23. Since the side walls 19 and 21 of the post 18*a* are wider than those of the post 18, ribs 25 are provided on the inner face of the interconnecting wall 23 as shown (or on the inside of side walls 19 and 21 if desired) so that the bottom wall 308 of bracket 300 will engage the ribs 25, and therefore a larger bracket 300 is not required.

Figure 18:
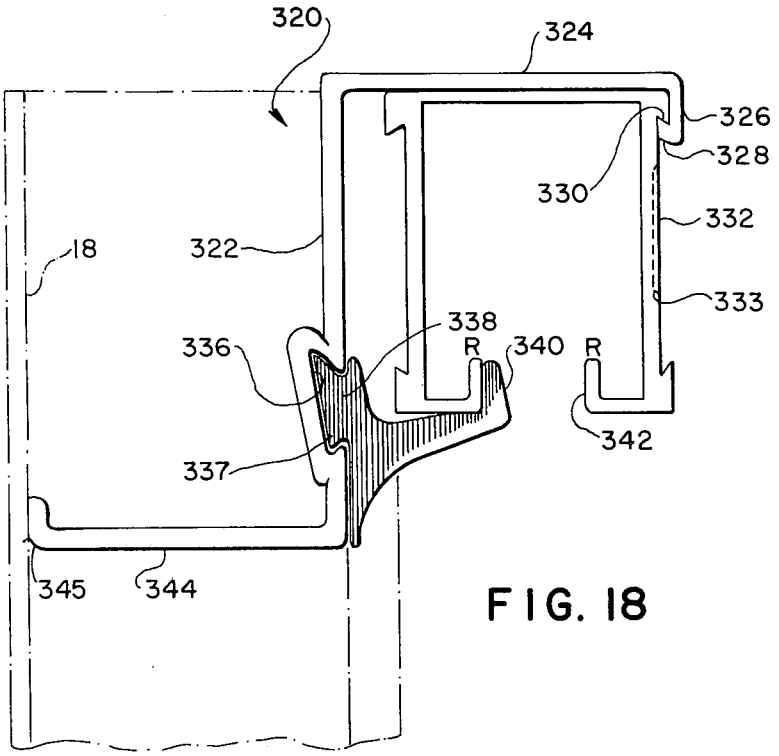

In FIG. 18 an alternate form of the post cap or bracket of FIG. 6 is shown at 320. It will be noted that the bracket 320 has no wall 84 and that a portion of the top wall 88 has been eliminated. The alternate bracket 320 comprises a side will 322 integrally joined to a top wall 324 terminating in an integral flange 326 extending downwardly therefrom at right angles and an inwardly and upwardly extending projection 328. The inward extending projection 328 is adapted to engage in a dove tail shaped groove 330 in a side wall 333 of an alternate form of top rail 332. The bracket 320 is similar to bracket 300 described above with reference to FIG. 17 in that a dove tail groove 336 is provided to receive a dove tail shaped projection 337 on a projection 338 which performs substantially the same function as the projection 94 described with reference to FIG. 6 and has an upwardly extending portion 340 adapted to extend into the channel 342 of the top rail 332. A bottom wall 344 extends from the lower end of the wall 322 and has an upturned flange 345 adapted to bear against the back wall of the line post 18 when downward pressure is exerted on the top rail 332.

Figure 19:
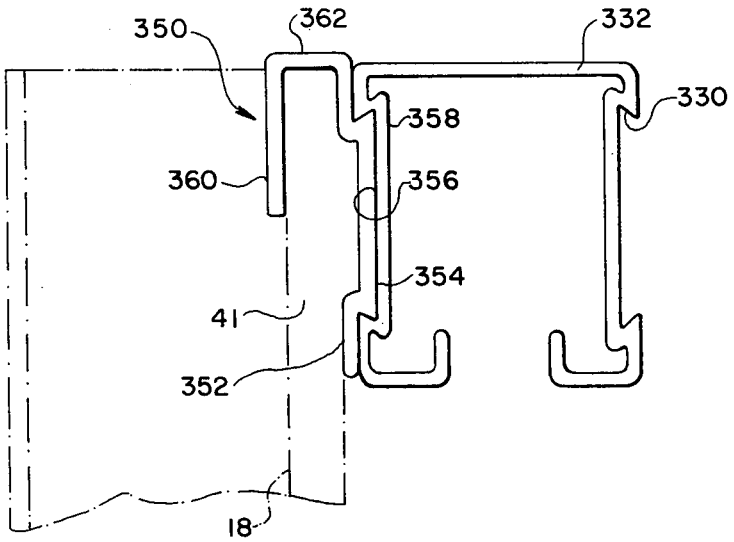

A further alternative form of bracket indicated generally by numeral 350 in FIG. 19 may be used to secure the top rail 332 to the line post 18. The bracket 350 includes a wall 352 having an integral substantially dove tail shaped projection 354 adapted to be received in a dove tail shaped groove 356 in a side wall 358 of the top rail 332 and a downwardly depending flange 360 integrally connected to the wall 352 by a top wall 362. The dimensions of the top wall 362 and the depending flange 360 are such that the flange 360 is received in the open end of the post and firmly engages the J shaped portions 41 of the line post 18.

Figure 20:
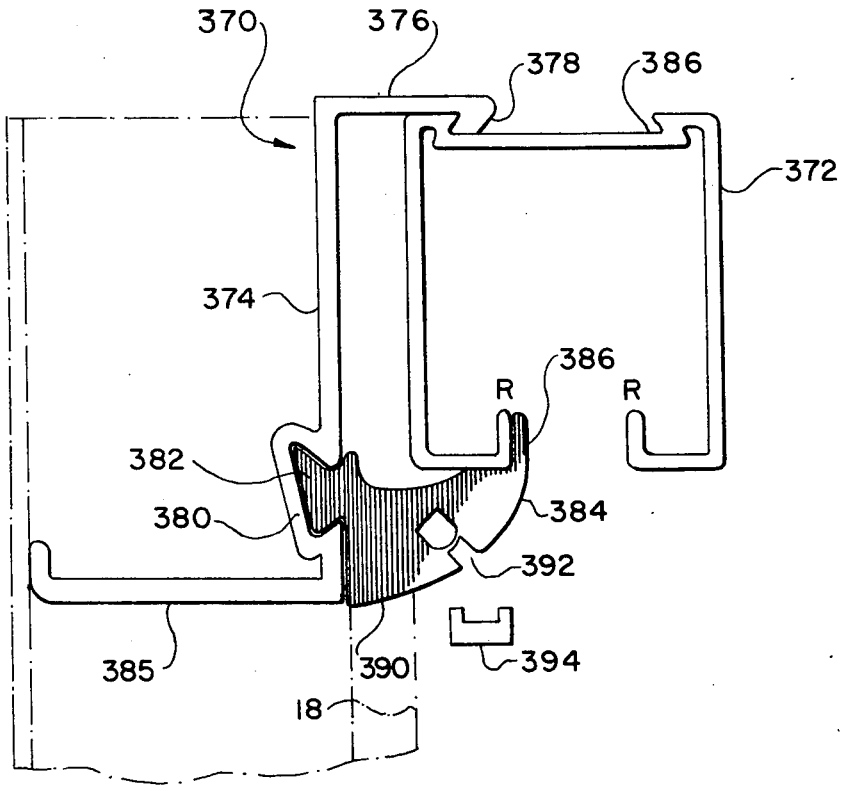

In FIG. 20 a further alternate construction of a line post bracket is shown generally at 370 for holding a modified top rail 372 on a line post 18. The bracket 370 includes a wall 374 integrally joined to a top wall 376 which terminates in an integral downwardly directed projection 378. A lower portion of the wall 374 is provided with a dove tail shaped groove 380 to receive a dove tail shaped part 382 on a projection 384. The projection 384 has an upwardly extending portion 386 to hold the rail 372 in a manner similar to that described with reference to FIG. 6. A bottom wall 385 is also provided on the bracket 370.

It will be noted that the rail 372 has a dove tail shaped groove formed in its connecting wall 386 to receive the downwardly and inwardly extending projection 378 of the bracket 370. A further difference between the bracket 370 and those previously described is that it is provided with a a slot 390 having a narrow opening 392 to receive; a key 394. The body of the key 394 is so shaped and dimensioned that when it is turned about its longitudinal axis in the slot 390 it binds in the slot and cannot be removed through the opening 392. Furthermore the key 394 binds against the line post 18 so as to resist upward movement of the bracket 370.

FIG. 1 of the application shows a fence 10 having three types of webing material namely chain link, wood slats and metal panels. However, any number of materials can be used without departing from the teaching of this invention. In FIGS. 21 to 25 a novel fence construction shown generally at 400 has elongated spaced apart channel members or slats 402 on alternate sides of the top rail 14 of the fence 10. The channel member 402 have a pair of opposed side walls 404 and an interconnecting wall 406. The outer side edges of the side walls 404 are bent inwardly to provide flanges 408. The flanges 408 have apertures 410, as shown more clearly in FIG. 22 to receive wire fasteners 412 which extend across the top rail 14 so as to support the channel members 402.

It should be noted that apertures 410 are also provided adjacent the lower ends of channel members 402 so that fasteners 412 will also extend across the bottom rail 16.

Figures 21, 22, 23, 24, 25:
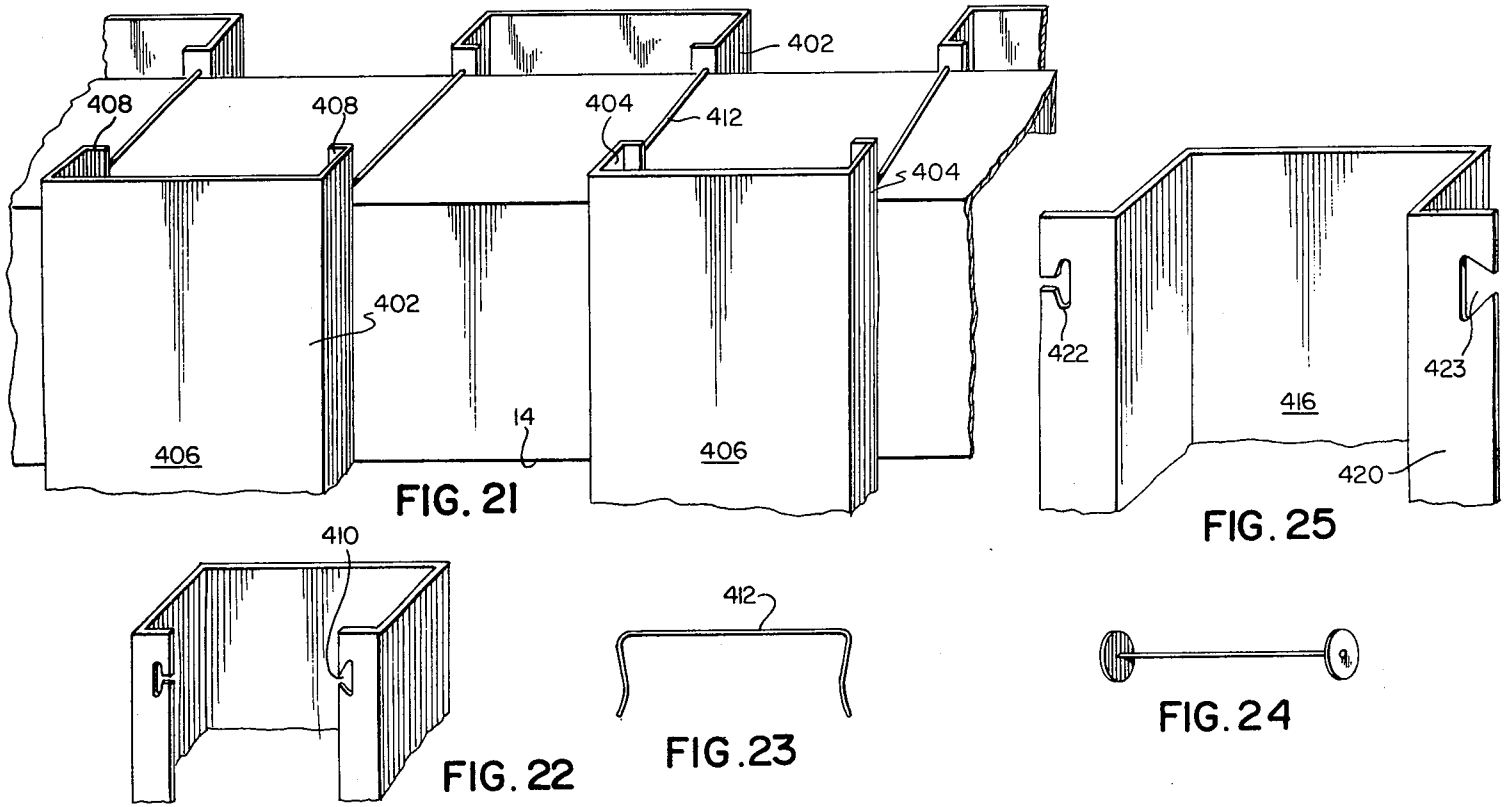

FIG. 24 shows an alternate fastener 414 for use in the same manner as the fastener 412. The fastener 414 comprises a rod having a head at each end.

FIG. 25 shows an alternate form of panel 416 having out turned flanges 420 and different shaped apertures 422 and 423.

The posts and rails of the fence 400 are assembled in much the same manner as that shown in FIG. 9, with the exception that the bottom rail 16 is inverted and a washer 132 is provided on the bolt 138 so that the washer 132 engages the rail 16. The panels 406 are secured to the top rail 14 by the fasteners 412 while the bottom fasteners 412 are being inserted the bottom rail 16 is raised slightly by loosening the nut 142. The bottom rail 16 is then lowered and the nut 142 tightened to hold down the bottom rail 16 thus locking all of the fasteners 412 in the slots 410.

It is also considered desireable to locate the apertures 410 closer to one end the other so that in case the bottom rail has been installed too close to the ground the panels 406 may be turned end for end.

It should be pointed out that assembly of the fence 10 is facilitated due to the fact that rails 14 and 16 and fabric 20 do not have to be cut to fit between line posts 18. Rails twenty feet in length are secured to the side of the line posts 18 by top rail brackets 90 and bottom rail brackets 120. Lengths of rail are spliced together as by a channel member inserted in adjacent ends of the rails, to provide rails long enough to extend between corner posts 12 and the ends trimmed so as to abut the corner post. It should be pointed out that the corner post is positioned so that the rails 14 & 16 are in alignment with the corner post and will slip over the brackets 120 provided on the corner post or terminal post.

Since the channels in the top rail, bottom rail and corner posts are in alignment it is possible to insert the edges of the chain link fabric in the channels and secure the chain link to the rails by means of the special tie wires 170 or to the corner post 12 by turning the end link of the chain link fabric.

The embodiments of the invention in which an exclusive property or privilege is claimed are defined as follows:

1. In a fence including line posts and top rails in the form of channel members, a top rail bracket for use on an upper end of said line post for securing said top rail to the side of the post, said bracket having a side wall adapted to be received in an open upper end of said line post, a top wall one edge of which terminates in a downwardly extending flange adapted to engage said top rail and a projection on said side wall adapted to extend through an opening in said channel type post to support said top rail and terminating in an upwardly extending projection extending into a channel in the underside of said top rail.

2. A bracket as claimed in claim 1 wherein an inner end of said projection is dove tail shaped so as to be received in and engage a dove tail shaped groove in said side wall of said bracket.

3. A bracket as claimed in claim 1 wherein said top wall also extends away from said side wall toward said line post whereby in use said top wall covers the open end of the line post.

4. A bracket as claimed in claim 1 wherein a bottom wall extends substantially at right angles from the lower edge of the side wall and is connected thereto, said bottom wall being so dimensioned that it is received in said line post and has its edges adjacent walls of the line post when in use so that an end edge of said bottom wall will engage a back wall of said line post when downward pressure is applied to said top rail.

5. A top rail bracket for use on an upper end of a line post of a fence, said bracket having a side wall, a top wall one edge of which terminates in a downwardly and inwardly extending flange adapted to engage a dove tail shaped groove on a top wall of said top rail and a projection on said side wall adapted to extend through an opening in said channel type post to support said rail and terminating in an upwardly extending projection extending into a channel in the underside of the rail so as to urge said rail and said post together.

6. A cap for a line post of a fence system, said cap having means for engaging said line post and being adapted to be received by an upper end thereof, a top wall of said cap having an extension extending beyond a side wall of the cap and terminating in a depending flange and an upwardly extending projection on said cap adapted to be received in a channel in an underside of a channel member forming a top rail of said fence, said top rail being engaged between said projection and said line post whereby said rail is inserted at an angle to said cap with a bottom portion thereof engaging said upwardly extending projection and said rail is then rotated so as to be engaged by said depending flange, said cap is then mounted on an upper end of said line post.

7. A cap as claimed in claim 6 wherein each said post has a substantially T shaped cross section, said side wall of said cap being bifurcated to allow one wall of said post to extend therethrough, two lower ends of said wall are joined by said means for engaging said line post and said projection is joined to said means for engaging said line post.

* * * * *